United States Patent [19]

Castonguay et al.

[11] Patent Number: 4,894,631

[45] Date of Patent: Jan. 16, 1990

[54] MOLDED CASE CIRCUIT BREAKER ACTUATOR-ACCESSORY UNIT

[75] Inventors: Roger N. Castonguay, Terryville; Joseph G. Nagy, Plainville; Richard E. Bernier, Southington; Ronald D. Ciarcia, Bristol; Keith W. Klein, Simsbury, all of Conn.

[73] Assignee: General Electric Company, New York, N.Y.

[21] Appl. No.: 240,885

[22] Filed: Sep. 6, 1988

[51] Int. Cl.[4] ..... H01H 9/20

[52] U.S. Cl. ..... 335/167; 335/172

[58] Field of Search ..... 335/167–185, 335/202, 199, 20, 6, 18; 174/65 G, 65 R, 153 R

[56] References Cited

U.S. PATENT DOCUMENTS 2,976,663 10/1981 Seymour et al. .
4,589,052 5/1986 Dougherty .
4,622,444 11/1986 Kandatsu et al. .
4,641,117 2/1987 Willard .
4,679,019 7/1987 Todaro et al. .
4,700,161 10/1987 Todaro et al. .
4,728,914 3/1988 Morris et al. .
4,806,893 2/1989 Castonguay et al. ..... 335/20

FOREIGN PATENT DOCUMENTS 2033177 5/1980 United Kingdom .

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit breaker which includes basic overcurrent protection facility along with selective electrical accessories. A molded plastic accessory access cover secured to the integrated protection unit cover protects the accessory components contained within the integrated protection unit cover from the environment. A combined overcurrent trip actuator and multiple accessory unit can be field-installed within the integrated protection unit. The combined actuator-accessory unit includes electronic control circuitry for the accessories along with mechanical trip and reset interface components.

24 Claims, 6 Drawing Sheets

MOLDED CASE CIRCUIT BREAKER ACTUATOR-ACCESSORY UNIT

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. An example of one such factory installed circuit breaker accessory is found in U.S. Pat. No. 4,297,663 entitled "Circuit Breaker Accessories Packaged in a Standardized Molded Case", which Patent is incorporated herein for reference purposes.

A more recent example of a circuit breaker including additional accessories is found in U.S. Pat. No. 4,622,444 entitled "Circuit Breaker Housing and Attachment Box" which allows the accessories to be field-installed within the circuit breaker without interfering with the integrity of the circuit breaker internal components. This is accomplished by mounting the accessories within a recess formed in the circuit breaker enclosure cover.

An electronic trip actuator which is mounted within the circuit breaker enclosure is described within U.S. Pat. No. 4,679,019 entitled "Trip Actuator for Molded Case Circuit Breakers". The circuit breaker actuator responds to trip signals generated by an electronic trip unit completely contained within a semi-conductor chip such as that described within U.S. Pat. No. 4,589,052. The development of a combined trip actuator for both overcurrent protection as well as accessory function is found within U.S. Pat. No. 4,700,161 entitled "Combined Trip Unit and Accessory Module for Electronic Trip Circuit Breakers". The aforementioned U.S. patents which represent the advanced state of the art of circuit protection devices are incorporated herein for reference purposes.

A shunt trip accessory unit allows the circuit breaker operating mechanism to be articulated to separate the circuit breaker contacts, usually to perform a tripping function for electrical system control and protection. One such shunt trip accessory unit is described within U.S. Pat. No. 4,786,885 entitled "Molded Case Circuit Breaker Shunt Trip Unit". An auxiliary switch accessory unit allows an operator to determine the "ON" or "OFF" conditions of a molded case circuit breaker contacts at a remote location by means of an audible alarm or visible display. One such auxiliary switch unit is described within U.S. Pat. No. 4,794,336 entitled "Molded Case Circuit Breaker Auxiliary Switch Unit". Both of the aforementioned U.S. patent applications are incorporated herein for purposes of reference.

One example of an undervoltage release circuit is found within United Kingdom patent application No. 2,033,177A entitled "Circuit Breaker with Undervoltage Release". The circuit described within this application applies a large initial current pulse to the undervoltage release coil to drive the plunger against the bias of a powerful compression spring and uses a ballast resistor to limit the holding current to the undervoltage release coil to a lower value. It is believed that the heat generated within this circuit would not allow the circuit to be contained within the confines of the circuit breaker enclosure.

A more recent example of a combined overcurrent trip actuator and multiple accessory unit is described within U.S. Pat. No. 4,788,621 entitled "Molded Case Circuit Breaker Multiple Accessory Unit" which combined overcurrent trip actuator and multiple accessory unit requires a separate mounting recess within the circuit breaker cover to house the printed wire board that carries the accessory control circuit. This Application is incorporated herein for reference purposes.

U.S. Pat. No. 4,806,893 describes a molded case circuit breaker actuator-accessory unit wherein the integrated overcurrent trip actuator and multiple accessory unit containing the control electronics and mechanical interface components are contained on a single structure mounted within a single recess. This Application is also incorporated herein for reference purposes.

The instant invention improves over the earlier trip actuator driver by arranging the trip actuator components in such a manner that the actuator can be operated in any orientation without affecting the actuator response.

SUMMARY OF THE INVENTION

An integrated protection unit which includes overcurrent protection along with auxiliary accessory function within a common enclosure contains an accessory cover for access to the selected accessory components to allow field installation of the accessory components. A combined actuator-accessory unit provides overcurrent, shunt trip or undervoltage release functions and is arranged within one part of the enclosure. The printed wire board containing the accessory control circuit is arranged within the same part of the enclosure. An additional latch return spring allows the trip actuator to be operated in any position without nuisance tripping the associated circuit interrupter.

DESCRIPTION OF THE PREFERRED EMBODIMENT

Figure 1:
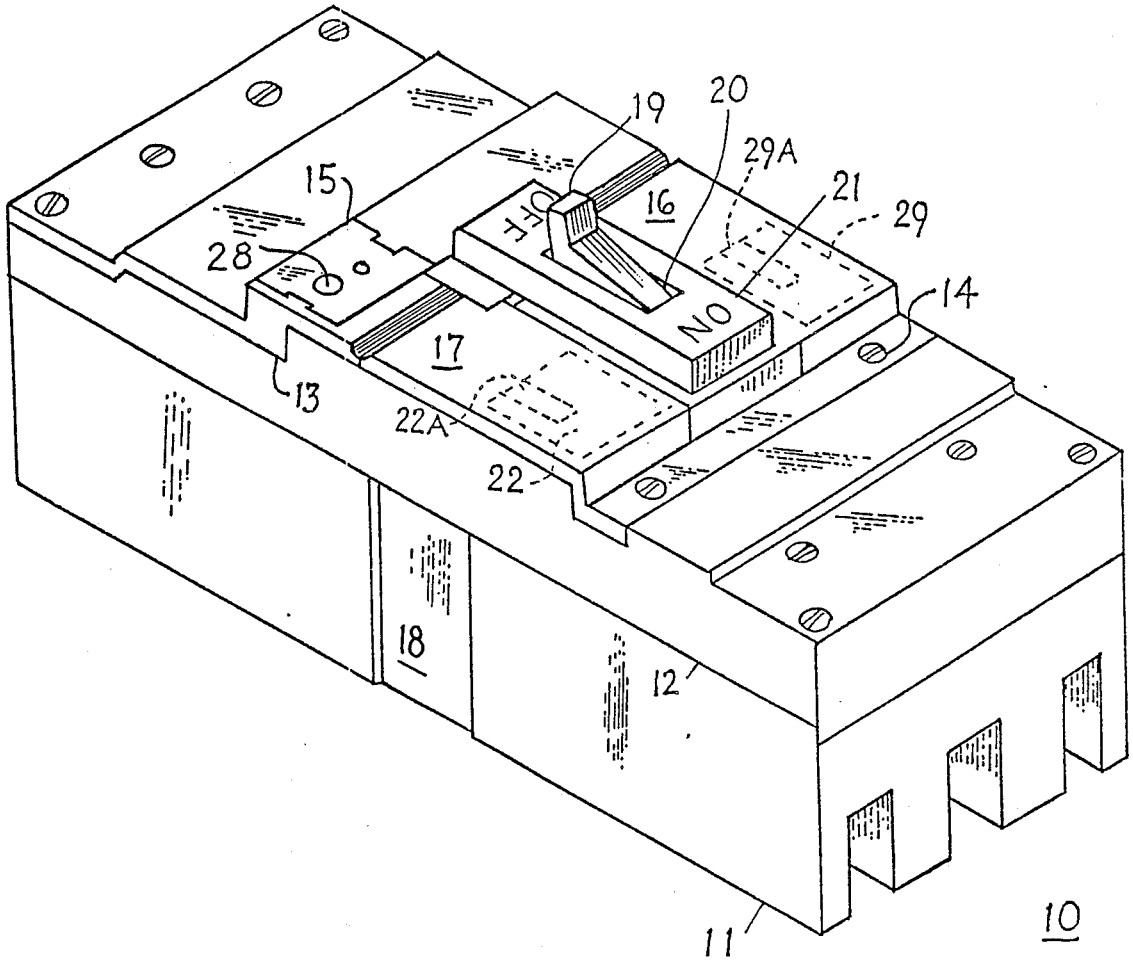
FIG. 1 is a top perspective view of an integrated molded case circuit breaker containing selected accessory functions.
Figure 2:
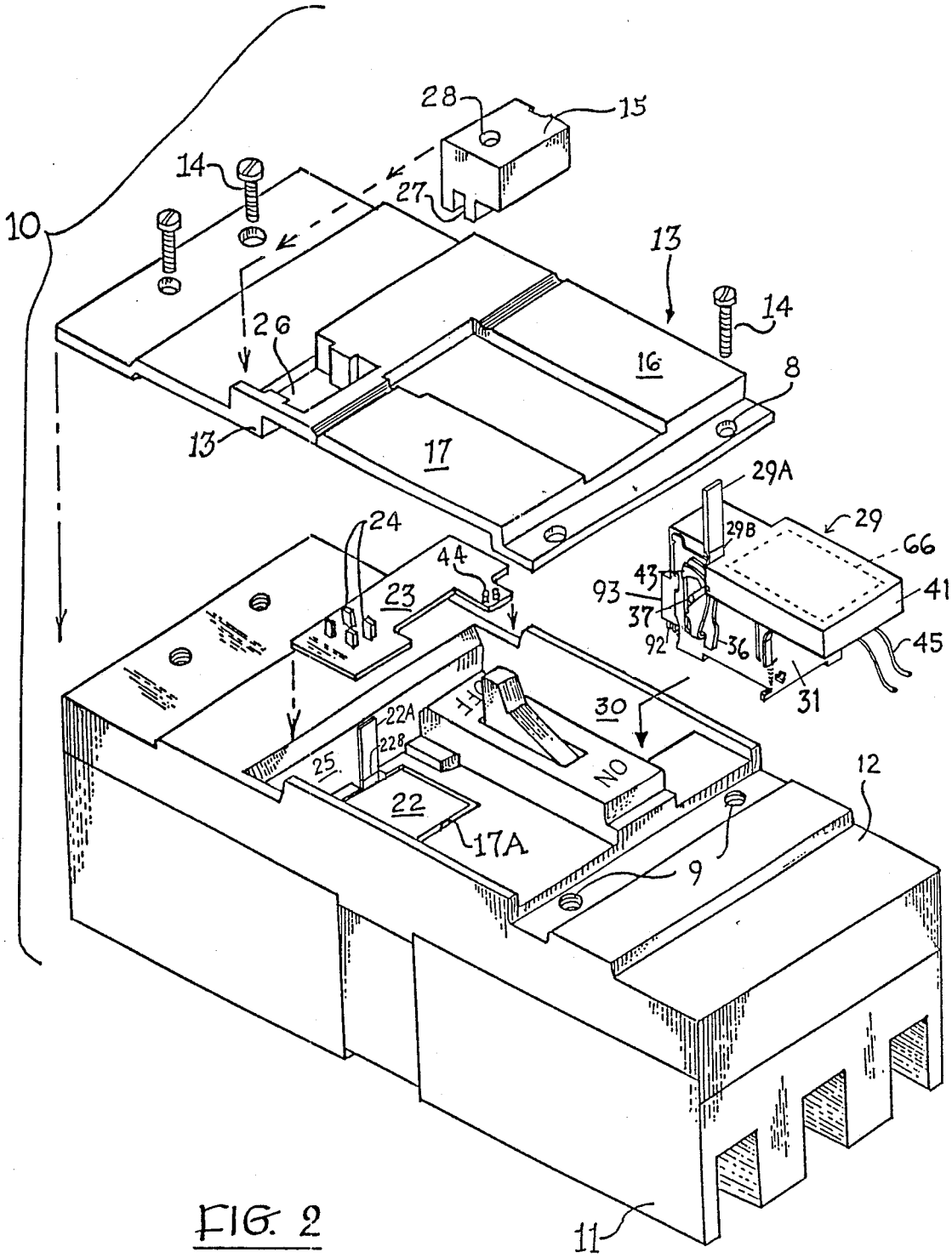
FIG. 2 is an exploded top perspective view of the integrated circuit breaker of FIG. 1 prior to assembly of the combined actuator-accessory unit according to the invention.

An integrated circuit breaker 10 consisting of a molded plastic case 11 with a molded plastic cover 12 is shown in FIG. 1 with the accessory cover 13 attached to the circuit breaker cover by means of screws 14. The case includes a wiring slot 18 formed therein for allowing external connection with a remote switch or alarm. The circuit breaker operating handle 19 extends up from an access slot 20 formed in the cover escutcheon 21. A rating plug 15 such as described in U.S. Pat. No. 4,728,914 entitled "Rating Plug Enclosure for Molded Case Circuit Breakers", which Patent Application is incorporated herein for reference purposes, is shown assembled within the accessory cover. A pair of accessory doors 16, 17 are formed in the accessory cover for providing access to the combined electromagnetic actuator and multiple accessory unit 29, hereafter "actuator-accessory unit" and the auxiliary switch 22 shown behind the accessory doors. Access tabs 22A and 29A are shown on the top surface of the auxiliary switch 22 and the actuator-accessory unit 29 for purposes to be described below in greater detail. The rating plug 15 is fitted within a recess formed in the accessory cover 13 and the accessory cover is fastened to the circuit breaker cover by means of screws 14, thru-holes 8 and threaded openings 9 as shown in FIG. 2. Access to the rating plug interior for calibration purposes is made by means of the rating plug access hole 28.

Figure 3:
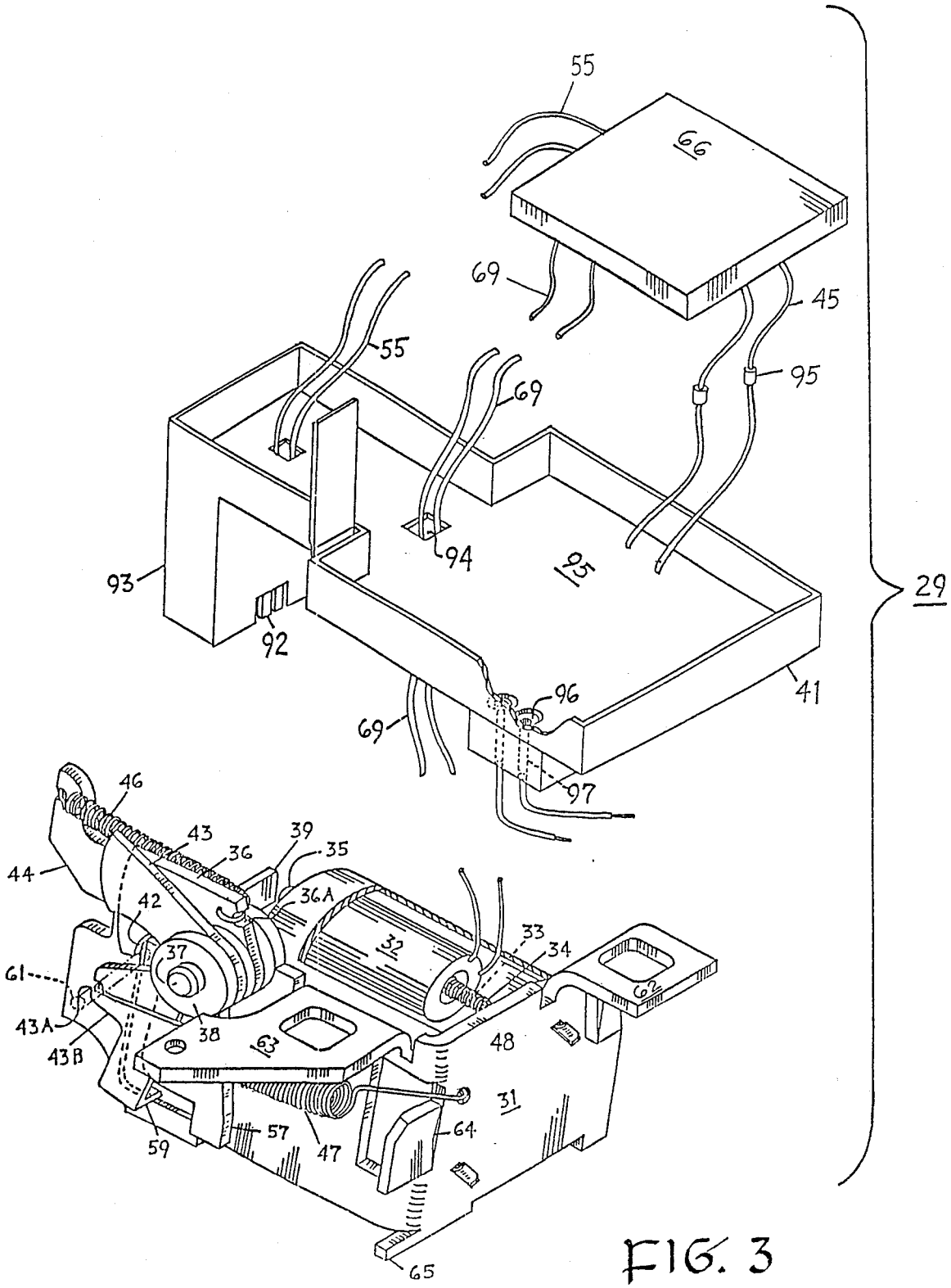
FIG. 3 is a top perspective view of the mechanical actuator and magnetic latch arrangement of the actuator-accessory according to the invention.
Figure 4:
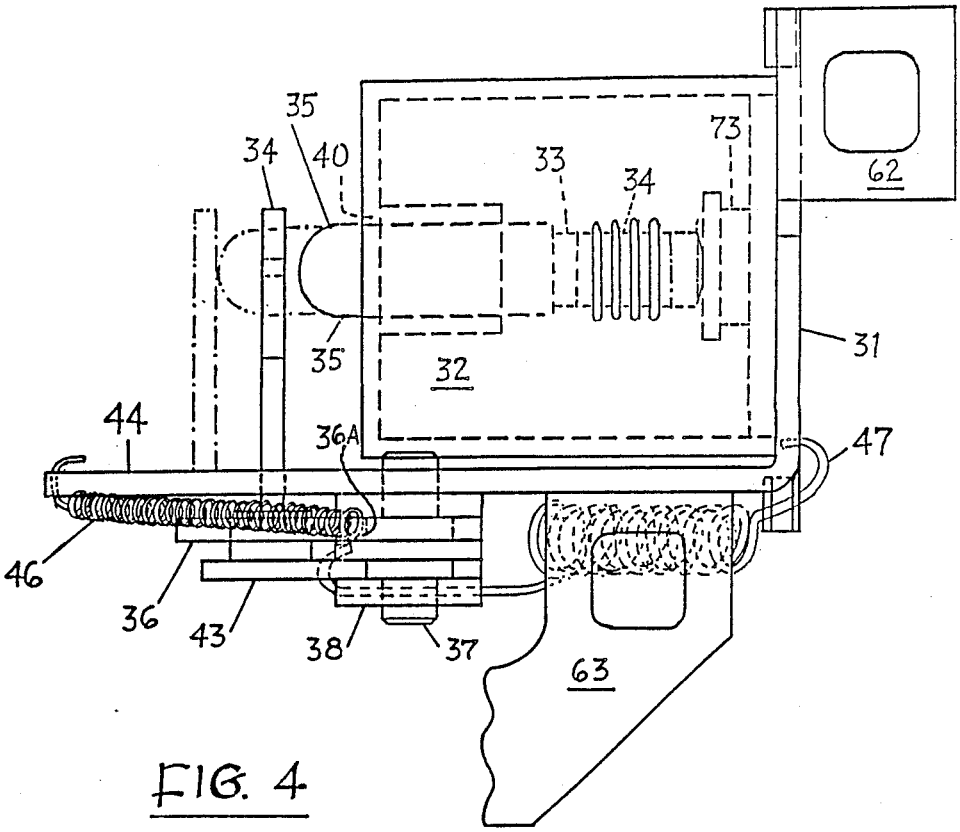
FIG. 4 is a top view of the mechanical actuator and magnetic latch arrangement of the actuator-accessory of FIG. 3.
Figure 5:
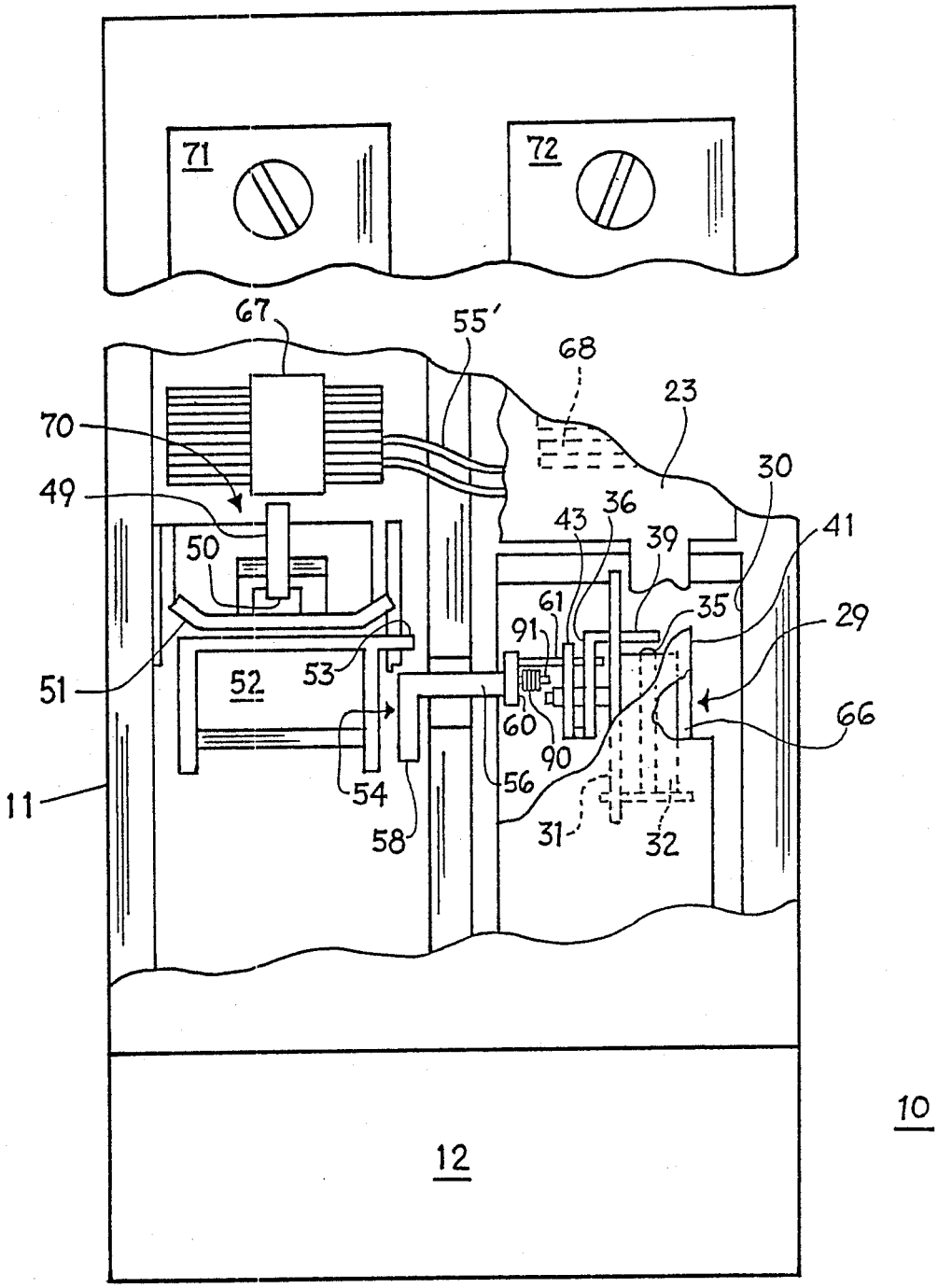
FIG. 5 is a plan view of the integrated molded case circuit breaker with part of the cover removed to show the circuit breaker operating mechanism and combined actuator-accessory unit.

The trip unit for the integrated circuit breaker 10 is contained within a printed wire board 23 shown in FIG. 2 which is positioned in the trip unit recess 25. The rating plug 15 when inserted within the rating plug recess 26 interconnects with the printed wire board by means of pins 24 upstanding from the printed wire board and sockets 27 formed on the bottom of the rating plug. The pins 44 upstanding from the printed wire board connect with the electrical connector 92 provided on the bottom of extension 93 formed on the plastic top piece 41 which is attached to the actuator-accessory unit 29. The auxiliary switch 22 is positioned within the auxiliary switch recess 17A and is similar to, that described in aforementioned U.S. Pat. No. 4,794,356 entitled "Molded Case Circuit Breaker Auxiliary Switch Unit". When the auxiliary switch and trip unit printed wire board have been assembled within their appropriate recesses, the actuator-accessory unit 29 is then installed within the actuator-accessory unit recess 30. When the actuator-accessory unit 29 and the auxiliary switch 22 are positioned within the circuit interrupter cover 12 and the accessory cover is closed, the upstanding access tabs 29A, 22A formed thereon become folded over their respective reduced thickness regions 29B, 22B and assume the positions indicated earlier with respect to FIG. 1. When the accessory cover is opened, the access tabs return to their upright positions to allow an operator to grasp the tabs and remove the respective actuator-accessory unit and auxiliary switch from the circuit interrupter cover. As shown in FIGS. 2, 3 and 4, the actuator-accessory unit is enclosed within a metallic housing 31 through which the trip actuator latch 36 and armature reset lever 43, hereafter "reset lever", extend and within which the actuator-accessory coil 32 is enclosed. The reset spring 47 and the take-up spring 46 shown in FIGS. 3 and 4 are not shown on the actuator-accessory unit 29 of FIG. 2 for purposes of clarity. The housing also contains an armature 33 and armature spring 34 which projects the armature extension 35 in a forward trip position against the holding force provided by the energized actuator-accessory coil 32. The plastic top piece 41 contains the printed wire board 66 which controls the operation of the actuator-accessory coil to which it is connected by conductors 69 which pass through an opening 94 formed in the bottom of the top piece. The printed wire board connects with the electrical conductors 55 as indicated, and with an external control circuit over conductors 45. The conductors 45 are fitted with wire retainer metallic sleeves 95 which sit in openings 96 formed in the bottom of the plastic top piece while the conductors 45 pass through smaller openings 97 formed thereunder. The metallic sleeves provide strain relief to the conductors and prevent the conductors from being pulled away from the printed wire board 66 when external force is applied. The actuator-accessory unit 29 is depicted in FIGS. 3, 4 and 5 with the printed wire board outside of the plastic top piece and the top of the housing partially removed to show the interaction between the actuator-accessory coil 32 and the trip actuator latch 36. The armature extension 35 projects through a slot 40 formed in the housing in proximity to a trip actuator arm 39 at one end of the trip actuator latch 36. The trip actuator latch is pivotally attached to the housing 31 by means of a pivot pin 37 and by means of spacer-washers 38. A hook 42 formed at one end of the trip actuator latch cooperates with the circuit breaker operating mechanism shown in aforementioned U.S. Pat. No. 4,700,161 and U.S. Pat. No. 4,806,893 in the manner to be described below in greater detail. The operation of the actuator-accessory unit 29 is similar to that described within U.S. Pat. No(s). 4,641,117 and 4,679,019 which patents are incorporated herein for purposes of reference. The pair of wire conductors 45, as described earlier, connect the actuator-accessory unit with a remote switch or voltage source when undervoltage protection or shunt trip facility is desired. The actuator-accessory unit 29 differs from that described within aforementioned U.S. Pat. application Ser. No. 163,589 by providing the reset lever 43 outboard the trip actuator latch 36 on the common pivot pin 37. The earlier actuator-accessory unit required complex additional components to compensate for the additional motion developed during the reset of the armature. The instant invention provides armature reset means which are less complex and more suited to high speed manufacture by not requiring compensation for any additional motion during reset of the armature. The reset lever of the instant invention for resetting the armature 33 is sandwiched between a pair of spacer-washers 38 similar to the trip actuator latch 36. The reset lever is biased by means of a powerful reset spring 47 attached between an opening 48 in the support 31 and a slot 43A formed on a projection 43B of the reset lever. The trip actuator latch 36 is biased by means of a lighter takeup spring 46 attached to a slot on the housing and to a slot 36A on the end of the trip actuator latch opposite the hook 42. The platforms 62, 63 formed on the top of the housing 31 support the plastic top piece 41 when the printed wire board 66 is inserted therein.

Before describing the detailed interaction between the trip actuator latch 36 and the reset lever 43, it is helpful to review the interaction between the trip actuator latch and the circuit breaker operating mechanism 70 in the integrated circuit breaker 10 as best seen by referring now to both FIGS. 3, 4 and 5.

Figure 6C:
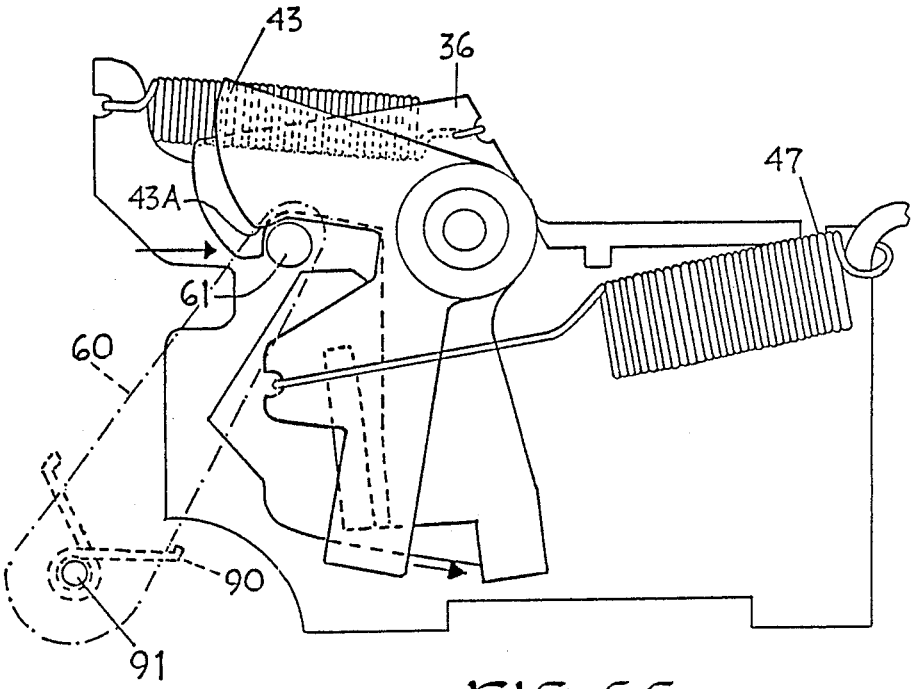
FIGS. 6A, 6B and 6C are side views of the mechanical actuator and magnetic latch arrangement of the actuator-accessory of FIGS. 4 and 5 in various latched and reset conditions.
Figure 6A:
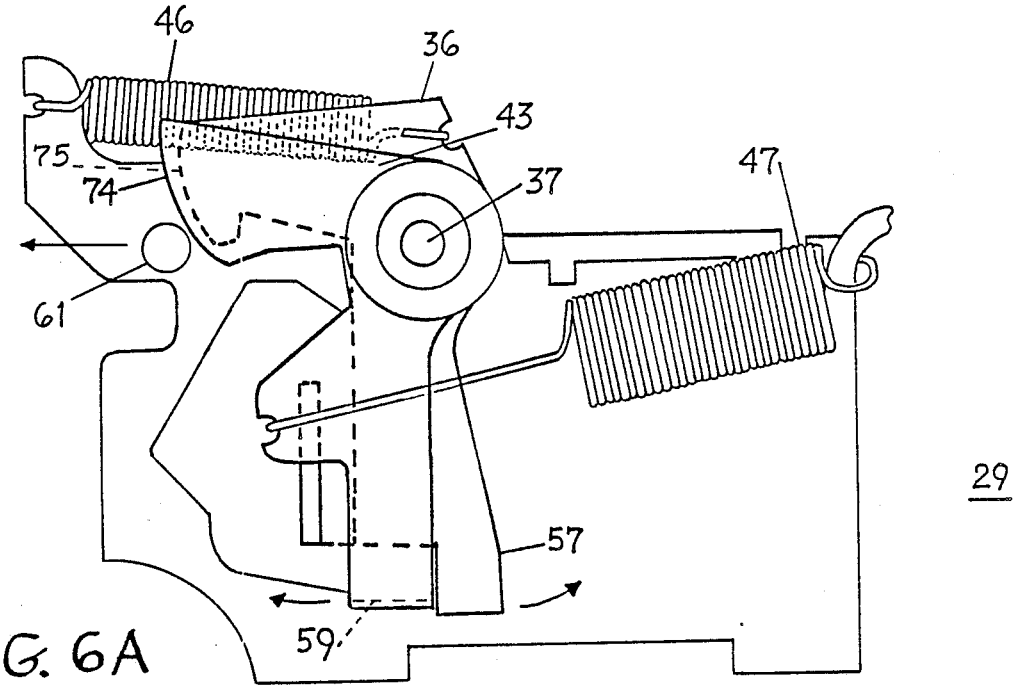
Figure 6B:
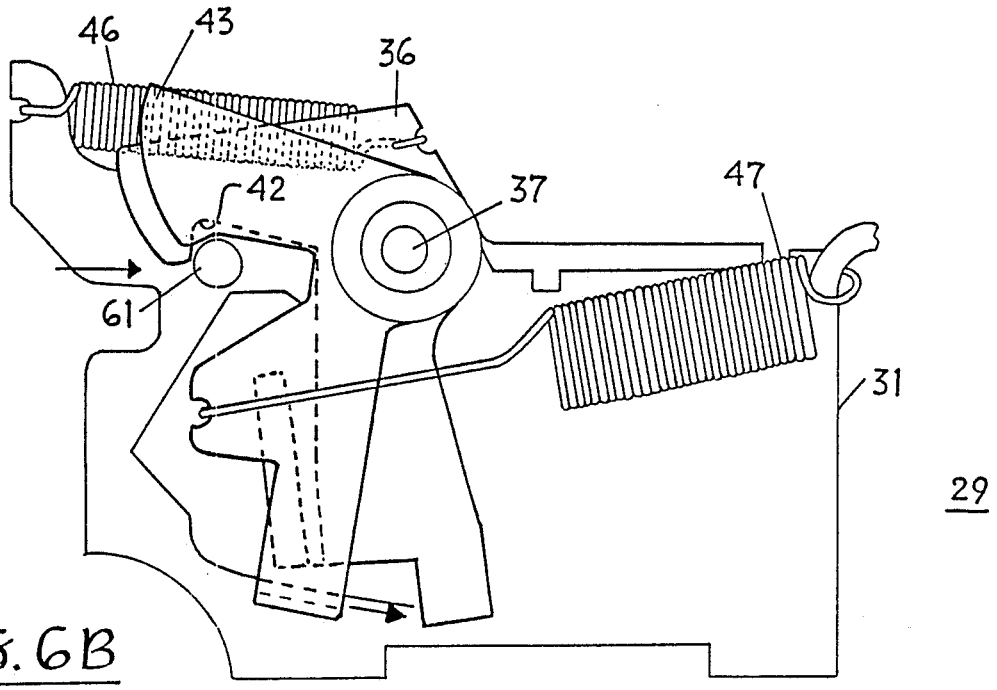

The actuator-accessory unit 29 is depicted in FIG. 5 within the recess 30 in the integrated circuit breaker 10 with part of the trip unit printed wire board 23, actuator-accessory unit printed wire board 66 and cover 12 removed to show the interaction between the actuator-accessory unit and the mechanical actuator 54 which sits in the integrated circuit breaker cover 12. The circuit breaker operating mechanism shown generally at 70 includes a cradle operator 49 having a hook 50 formed at one end thereof which is retained by means of a primary latch 51. The secondary latch assembly 52 prevents the primary latch 51 from releasing the operating cradle 49 until the secondary latch is displaced by contact with a tab 53 extending from the secondary latch. Electric current flow is sensed by a pair of current transformers 67, 68 which are located ahead of load lugs 71, 72. The current transformers connect with the trip unit printed wire boa 23 by means of conductors 55'. The operating lever 58 sits within the case 11 and connects with the latch support arm 60 in the recess 30 by means of connecting arm 56. The latch pin 61 is retained by the trip actuator latch 36 which is in turn controlled by the position of the trip actuator arm 39 which extends through the actuator-accessory housing 31. The trip actuator arm 39 interfaces with the armature extension 35 in the following manner. When the circuit current exceeds a predetermined value, a current pulse is applied to the actuator-accessory coil 32 to oppose the holding force provided by the permanent magnet 73 thereby allowing the armature extension 35 to be propelled by the urgency of the armature spring and to thereby rotate the trip actuator latch 36 in the clockwise direction about pivot pin 37 and to release the hook 42 from the latch pin 61. The rotation of the trip actuator latch 36 allows the latch support arm 60 to rotate in the counterclockwise direction under the urgency of a powerful trip spring 90 arranged around the latch support arm pivot 91. The rotation of the latch support arm 60 in the counterclockwise direction drives the operating lever 58 into contact with the tab 53 thereby articulating the circuit breaker operating mechanism 70 to separate the circuit breaker contacts (not shown). The interaction between the trip actuator latch 36 and the reset lever 43 is best seen by referring now to FIGS. 3, 4, 6A, 6B and 6C. The "Latched" condition of the actuator-accessory unit 29 is shown in FIG. 3 wherein the latch pin 61 is depicted in phantom and is engaged by the hook 42 provided at one end of the trip actuator latch 36. The "TRIPPED" condition of the actuator-accessory unit 29 is shown in FIG. 6A with the latch pin 61 out of engagement with the trip actuator latch 36. During the tripping function, described earlier with reference to FIG. 3, the trip actuator latch 36 is rotated first in the clockwise direction to release the latch pin. The reset lever then rotates in the counterclockwise direction under the influence of the reset spring 47. The bent tab 59 on the bottom of the reset lever which projects into the plane of the paper toward the trip actuator latch 36 engages an extension 57 formed on the bottom of the trip actuator latch such that both the trip actuator latch and the reset lever move together in unison. The take-up spring 46 attached to the trip actuator latch 36 responds immediately after release of the latch pin 61 to rotate the trip actuator latch in the counterclockwise direction. At the same time, the trip actuator arm 39 contacts the armature extension 35 and drives the armature extension back into contact with the permanent magnet 73 which again retains the armature 33 against the forward bias of the armature spring 34 as shown in FIG. 4. The immediate resetting of the armature extension after a tripping function is an important feature of the instant invention. When the circuit breaker is reset after the tripping function as described within the aforementioned U.S. Pat. No. 4,806,893, and the latch pin 61 is driven from the position indicated in FIG. 6A to that indicated in FIG. 6B, the latch pin first contacts the cam-shaped surface 74 on the reset lever 43 to move the reset lever clockwise against the return bias of the reset spring 47 whereby the latch pin 61 next contacts the cam-shaped surface 75 of the trip actuator latch 36 and allows the latch pin 61 to clear the hook 42 and assume the position indicated in FIG. 6B. The extended reset spring 47, immediately urges the reset lever 43 to rotate in the counterclockwise direction until the reset lever contacts the latch pin 61 which provides a stop to the reset lever as indicated in FIG. 3 while the take-up spring 46 rotates the trip actuator latch 36 and hook 42 over the latch pin 61 to allow the actuator-accessory unit to assume the latched position.

In the arrangement of the actuator-accessory unit 29 depicted in FIG. 6C the relationship between the reset lever 43 and reset spring 47 and the circuit interrupter latch support arm 60 indicated in phantom, is as follows. A shaped surface 43A on the underside of the reset lever 43 contacts the latch pin 61 and thereby reduces the latch force provided on the latch pin by means of the trip spring 90. The trip spring is arranged around a pivot 91 at the end of the latch support arm 60 opposite the latch pin, as fully described within the aforementioned U.S. Pat. No. 4,806,893. The shaped-surface is arranged to take some of the force away from the trip actuator latch 36 which interfaces with the latch support arm 60 through the latch pin 61. The reset spring 47, which is biased in opposition to the trip spring 90, thereby exerts an opposing force on the latch pin by means of the shaped surface and reduces the amount of force required by the armature (FIG. 4) to rotate the trip actuator latch away from the latch pin during a tripping operation.

Having thus described our invention, what I claim as new and desire to secure by Letters Patent is:

1. A molded case circuit breaker having a combined trip actuator and accessory unit comprising:

a molded case circuit breaker case and cover;

a circuit breaker operating mechanism arranged for separating a pair of contacts to interrupt circuit current through said contacts;

a trip actuator-accessory unit within a recess in said circuit breaker cover proximate said operating mechanism and including a trip actuator latch and a reset lever pivotally attached to a support housing for articulating said operating mechanism to separate said contacts automatically upon overcurrent conditions through said contacts, said reset lever and said trip actuator latch each comprising a radial cam surface for receiving and guiding a trip latch pin and allowing said trip actuator latch and said reset lever to move in unison with said trip latch pin;

an operating lever within said case proximate said operating mechanism and interfacing with said actuator-accessory unit through a latch support arm, said latch support arm including a latch pin being retained by said trip actuator latch in the absence of said overcurrent conditions through said contacts; and an electromagnetic coil and a spring-biased plunger within said actuator-accessory unit, said plunger being restrained from moving said trip actuator latch away from said latch pin.

2. The molded case circuit breaker of claim 1 wherein said trip actuator-accessory unit includes a metal support housing, said trip actuator latch and said reset lever being pivotally supported on said housing by means of a common pivot pin.

3. The molded case circuit breaker of claim 2 including a take-up spring attached to said housing at one end and to said trip actuator latch at an opposite end to bias said trip actuator latch in a counterclockwise direction.

4. The molded case circuit breaker of claim 2 including a reset spring attached to said housing at one end and to said reset lever at an opposite end to bias said reset lever in said counterclockwise direction.

5. The molded case circuit breaker of claim 1 wherein said reset lever includes a bent tab at an end thereof opposite said pivot pin and said trip actuator latch includes an extension at an end thereof opposite said pivot pin, said bent tab abutting said extension to cause said reset lever and said trip actuator to rotate in unison when said bent tab abuts said extension.

6. The molded case circuit breaker of claim 1 including a trip spring in said case biasing said latch support arm away from said trip actuator latch.

7. The molded case circuit breaker of claim 1 wherein said trip actuator latch includes a hook-shaped end for retaining said pin.

8. The molded case circuit breaker of claim 2 wherein said housing comprises a side wall, said electromagnetic coil and said plunger being mounted on one side of said side wall, said trip actuator latch and said reset lever being pivotally arranged on an opposite side of said side wall.

9. The molded case circuit breaker of claim 1 wherein said reset lever includes an angled tab extending from one end thereof and said trip actuator latch includes an extension on one end thereof, said tab abutting said extension to cause said trip actuator latch and said reset lever to rotate together in unison.

10. The molded case circuit breaker of claim 1 wherein said trip actuator-accessory unit includes an electronic circuit connected with said electromagnetic coil for controlling the position of said plunger.

11. The molded case circuit breaker of claim 10 wherein said electronic circuit is arranged within a plastic enclosure on a top surface of said recess, said plastic enclosure being attached to said support housing.

12. The molded case circuit breaker of claim 11 further including an accessory cover attached to said circuit breaker cover and arranged for covering said recess and said trip actuator-accessory unit therein.

13. The molded case circuit breaker of claim 12 including a pliable tab extending from a top surface of said plastic enclosure (in a plane perpendicular to said top surface) to allow removal of said trip actuator-accessory unit from said access whereby said accessory cover contacts said pliable tab when said accessory cover is closed to bend said pliable tab in a plane parallel to said top surface and whereby said pliable tab returns to said perpendicular plane when said accessory cover is opened.

14. The molded case circuit breaker of claim 1 including an additional recess in said circuit breaker cover on an opposite side of said operating mechanism, and an accessory device mounted within said additional recess.

15. The molded case circuit breaker of claim 14 wherein said accessory device is arranged within an additional plastic enclosure.

16. The molded case circuit breaker of claim 15 including an additional pliable tab extending from a top surface of said additional plastic enclosure in said perpendicular plane to allow removal of said accessory device from said additional recess.

17. A trip actuator-accessory unit for molded case circuit breakers comprising:

a support housing:

an electromagnetic coil within said housing arranged around a spring-biased armature, said armature being restrained from movement by magnetic means;

a trip actuator latch pivotally attached to said housing by means of a pivot pin and being biased for rotation in a counterclockwise direction by means of a take-up spring;

a reset lever pivotally attached to said housing by means of said pivot pin and being biased for rotation in said counterclockwise direction by means of a reset spring, said trip actuator latch and said reset lever each including a forward surface having an arcuate cam configuration for moving said trip actuator latch and said reset lever in unison; and means on said trip actuator latch interfacing with said armature whereby said armature strikes said trip actuator latch causing said latch to rotate in a clockwise direction when said magnetic means is cancelled.

18. The trip actuator-accessory unit of claim 17 wherein said reset lever further includes a shaped surface perpendicular to said forward surface for decreasing latching force applied to said trip actuator latch.

19. The trip actuator-accessory unit of claim 17 including a plastic housing on said support housing, said plastic housing including circuit board means controlling said electromagnetic coil.

20. The trip actuator-accessory unit of claim 17 including wire retention means on said plastic housing for preventing removal of wires connecting with said circuit board means.

21. The trip actuator-accessory unit of claim 20 wherein said wire retention means comprises concentric holes of differing diameter.

22. The trip actuator-accessory unit of claim 20 wherein said wire retention means includes a crimp on said wires, said crimp being inserted within one of said concentric holes.

23. The trip actuator-accessory unit of claim 19 wherein said plastic housing includes a pliable tab upstanding from a top surface of said housing for providing removal means to said plastic housing and said support housing.

24. The trip actuator-accessory unit of claim 22 wherein said support housing comprises metal.

* * * * *